US009587872B2

(12) United States Patent
Boarman et al.

(10) Patent No.: US 9,587,872 B2
(45) Date of Patent: Mar. 7, 2017

(54) REFRIGERATOR WITH THERMOELECTRIC DEVICE CONTROL PROCESS FOR AN ICEMAKER

(71) Applicant: Whirlpool Corporation, Benton Harbor, MI (US)

(72) Inventors: Patrick J. Boarman, Evansville, IN (US); Gregory G. Hortin, Henderson, KY (US)

(73) Assignee: Whirlpool Corporation, Benton Harbor, MI (US)

( * ) Notice: Subject to any disclaimer, the term of this patent is extended or adjusted under 35 U.S.C. 154(b) by 708 days.

(21) Appl. No.: 13/691,916

(22) Filed: Dec. 3, 2012

(65) Prior Publication Data

US 2014/0150462 A1 Jun. 5, 2014

(51) Int. Cl.

| | |
|---|---|
| ***F25B 21/02*** | (2006.01) |
| ***F25C 1/00*** | (2006.01) |
| ***F25B 21/00*** | (2006.01) |
| ***F25C 5/08*** | (2006.01) |
| ***F25C 5/00*** | (2006.01) |
| ***F25D 11/02*** | (2006.01) |

(52) U.S. Cl.

CPC ..... *F25C 5/08* (2013.01); *F25B 21/02* (2013.01); *F25C 5/005* (2013.01); *F25D 11/02* (2013.01); *F25B 2321/021* (2013.01); *F25B 2700/2107* (2013.01); *F25C 2600/04* (2013.01); *F25C 2700/12* (2013.01)

(58) Field of Classification Search

CPC ..... F25B 21/02; F25B 2321/021; F25B 2700/2107; F25C 2600/04; F25C 2700/12; F25C 5/005; F25C 5/08; F25D 11/02

USPC ..... 62/3.6, 135

See application file for complete search history.

(56) References Cited

U.S. PATENT DOCUMENTS

| | | | |
|---|---|---|---|
| 2,513,823 | A | 7/1950 | Shreve |
| 2,940,276 | A | 6/1960 | Loewenthal et al. |
| 3,192,726 | A | 7/1965 | Newton |
| 3,237,415 | A | 3/1966 | Newton |
| 4,448,032 | A | 5/1984 | Hibino et al. |

(Continued)

FOREIGN PATENT DOCUMENTS

| | | | |
|---|---|---|---|
| DE | 102010001465 | A1 | 8/2011 |
| DE | 102010042080 | A1 | 4/2012 |

(Continued)

OTHER PUBLICATIONS

EP Search Opinion, EP2738483, Dated Feb. 2, 2015.

(Continued)

*Primary Examiner* — Henry Crenshaw

(57) ABSTRACT

A refrigerator that has a fresh food compartment, a freezer compartment, and a door that provides access to the fresh food compartment is disclosed. An icemaker is mounted remotely from the freezer compartment. The icemaker includes an ice mold with an icemaking cycle having a liquid to ice phase change. A thermoelectric device has a cold side and a warm side. A controller is in operable communication with an input to the thermoelectric device. A sensor is in operable communication with the input to the thermoelectric device and the controller. A feedback response from the input to the thermoelectric device monitors the liquid to ice phase change of the icemaking cycle.

17 Claims, 4 Drawing Sheets

(56) References Cited

U.S. PATENT DOCUMENTS

| | | | | |
|---|---|---|---|---|
| 4,487,024 | A * | 12/1984 | Fletcher et al. | 62/3.63 |
| 4,487,032 | A | 12/1984 | Speicher | |
| 4,570,881 | A * | 2/1986 | Lustenberger | 244/134 F |
| 4,644,753 | A * | 2/1987 | Burke | 62/3.6 |
| 4,727,720 | A * | 3/1988 | Wernicki | 62/3.63 |
| 4,848,102 | A | 7/1989 | Stanfill | |
| 5,032,157 | A | 7/1991 | Ruff et al. | |
| 5,297,394 | A * | 3/1994 | Frohbieter et al. | 62/135 |
| 5,690,849 | A | 11/1997 | Devilbiss et al. | |
| 6,094,918 | A | 8/2000 | Burbidge et al. | |
| 6,219,364 | B1 * | 4/2001 | Dei | H01S 5/02415 372/34 |
| 6,293,107 | B1 | 9/2001 | Kitagawa et al. | |
| 6,412,286 | B1 | 7/2002 | Park et al. | |
| 6,456,200 | B1 * | 9/2002 | Bostrom et al. | 340/580 |
| 6,735,959 | B1 | 5/2004 | Najewicz | |
| 6,871,675 | B1 * | 3/2005 | Marszalec et al. | 141/82 |
| 6,908,163 | B1 | 6/2005 | Hebeler et al. | |
| 6,951,113 | B1 * | 10/2005 | Adamski | 62/3.62 |
| 7,681,406 | B2 | 3/2010 | Cushman et al. | |
| 8,240,159 | B2 | 8/2012 | Prabhakar et al. | |
| RE44,132 | E * | 4/2013 | Najewicz | 62/3.63 |
| 2004/0012314 | A1 | 1/2004 | Hay et al. | |
| 2006/0168983 | A1 | 8/2006 | Tatsui | |
| 2006/0254285 | A1 * | 11/2006 | Lin | 62/3.63 |
| 2006/0260325 | A1 | 11/2006 | Lin | |
| 2006/0260350 | A1 | 11/2006 | Van Meter | |
| 2006/0266059 | A1 | 11/2006 | Wetekamp et al. | |
| 2008/0059003 | A1 | 3/2008 | Doberstein et al. | |
| 2008/0106293 | A1 * | 5/2008 | Hashimoto | 324/760 |
| 2008/0141699 | A1 | 6/2008 | Rafalovich et al. | |
| 2009/0158770 | A1 * | 6/2009 | Cohrs et al. | 62/457.9 |
| 2009/0205342 | A1 * | 8/2009 | Jang et al. | 62/3.3 |
| 2009/0302724 | A1 | 12/2009 | Allard et al. | |
| 2010/0071384 | A1 | 3/2010 | Lu et al. | |
| 2010/0126185 | A1 * | 5/2010 | Cho et al. | 62/3.63 |
| 2010/0326093 | A1 * | 12/2010 | Watson | F25B 7/00 62/66 |
| 2010/0326112 | A1 | 12/2010 | Prabhakar | |
| 2011/0232888 | A1 | 9/2011 | Sasaki | |
| 2012/0047911 | A1 | 3/2012 | Bhavsar et al. | |
| 2012/0118001 | A1 | 5/2012 | Mitchell | |
| 2012/0151940 | A1 | 6/2012 | Uratani et al. | |
| 2012/0167596 | A1 | 7/2012 | Krause et al. | |

FOREIGN PATENT DOCUMENTS

| | | | |
|---|---|---|---|
| EP | 1517103 | A2 | 3/2005 |
| EP | 1821051 | A1 | 8/2007 |
| EP | 2322887 | A2 | 5/2011 |
| EP | 2444761 | A2 | 4/2012 |
| JP | 2000161835 | A | 6/2000 |
| JP | 2006084135 | A | 3/2006 |
| KR | 20110064738 | A | 6/2011 |
| WO | 2008130712 | A1 | 10/2008 |
| WO | 2009078562 | A1 | 6/2009 |

OTHER PUBLICATIONS

EP Search Opinion, EP2738484, Dated Feb. 23, 2015.
EP Search Opinion, EP2738485, Dated Feb. 2, 2015.
EP Search Opinion, EP2738496, Dated Feb. 2, 2015.
EP Search Opinion, EP2738497, Dated Feb. 2, 2015.
DE102010042080 Machine Translation from Espacenet.
DE102010001465 Machine Translation from Espacenet.
Vian, J. et. al, "Development of a Thermoelectric Ice Maker of Fingers Incorporated into a Static Domestic Refrigerator", 5th European Conference on Thermoelectrics, Sep. 10, 2007, pp. 1-6.
European Patent Office, "European Search Report," issued in connection with European Patent Application No. 13173609.2, mailed Aug. 29, 2016, 8 pages.
European Patent Office, "European Search Report," issued in connection with European Patent Application No. 13182465.8, mailed Dec. 2, 2016, 9 pages.
European Patent Office, "European Search Report," issued in connection with European Patent Application No. 13188928.9, mailed Dec. 2, 2016, 8 pages.
European Patent Office, "European Search Report," issued in connection with European Patent Application No. 13188925.5, mailed Dec. 14, 2016, 9 pages.
European Patent Office, "European Search Report," issued in connection with European Patent Application No. 13188923.0, mailed Dec. 14, 2016, 12 pages.

* cited by examiner

REFRIGERATOR WITH THERMOELECTRIC DEVICE CONTROL PROCESS FOR AN ICEMAKER

FIELD OF THE INVENTION

The invention relates generally to refrigerators with icemakers, and more particularly to refrigerators with the icemaker located remotely from the freezer compartment.

BACKGROUND OF THE INVENTION

Household refrigerators commonly include an icemaker to automatically make ice. The icemaker includes an ice mold for forming ice cubes from a supply of water. Heat is removed from the liquid water within the mold to form ice cubes. After the cubes are formed they are harvested from the ice mold. The harvested cubes are typically retained within a bin or other storage container. The storage bin may be operatively associated with an ice dispenser that allows a user to dispense ice from the refrigerator through a fresh food compartment door.

To remove heat from the water, it is common to cool the ice mold. Accordingly, the ice mold acts as a conduit for removing heat from the water in the ice mold. When the icemaker is located in the freezer compartment this is relatively simple, as the air surrounding the ice mold is sufficiently cold to remove heat and make ice. However, when the icemaker is located remotely from the freezer compartment, the control and removal of heat from the ice mold is more difficult.

Therefore, the proceeding disclosure provides improvements over existing designs.

SUMMARY OF THE INVENTION

According to one aspect, a refrigerator that has a fresh food compartment, a freezer compartment, and a door that provides access to the fresh food compartment is disclosed. An icemaker mounted remotely from the freezer compartment. The icemaker includes an ice mold with an icemaking cycle having a liquid to ice phase change. A thermoelectric device has a cold side and a warm side. A controller is in operable communication with an input to the thermoelectric device. A sensor is in operable communication with the input to the thermoelectric device and the controller. And, a feedback response from the input to the thermoelectric device monitors the liquid to ice phase change of the icemaking cycle. An ice to liquid phase change may also be monitored for an ice harvesting cycle or fresh ice production cycle.

According to another aspect, an icemaker is disclosed. The icemaker includes an ice mold with an icemaking cycle having a liquid to ice phase change and a thermoelectric device that has a cold side and a warm side. An input is provided to the thermoelectric device. A controller is in operable communication with the thermoelectric device and the input. A sensor is in operable communication with the thermoelectric device. A feedback response from the thermoelectric device to the controller is provided for monitoring the liquid to ice phase change of the icemaking cycle. An ice to liquid phase change may also be monitored for an ice harvesting cycle or fresh ice production cycle.

According to another aspect, a method for cooling in a refrigerator that has a fresh food compartment, a freezer compartment, and a door that provides access to the fresh food compartment is disclosed. The method provides an icemaker mounted remotely from the freezer compartment; the icemaker including an ice mold with an icemaking cycle having a liquid to ice phase. A thermoelectric device is also provided that has a cold side and a warm side. An input to the thermoelectric device is controlled using a controller in operable communication with the input and the thermoelectric device. A signal is sensed from a sensor in operable communication with the input to the thermoelectric device and the controller. The feedback response from the input to the thermoelectric device is monitored for determining the liquid to ice phase change of the icemaking cycle or an ice to liquid phase change for an ice harvesting cycle or fresh ice production cycle.

BRIEF DESCRIPTION OF THE DRAWINGS

While the specification concludes with claims particularly pointing out and distinctly claiming the invention, it is believed that the various exemplary aspects of the invention will be better understood from the following description taken in conjunction with the accompanying drawings, in which:

DETAILED DESCRIPTION OF THE PREFERRED EMBODIMENTS

Figure 1:
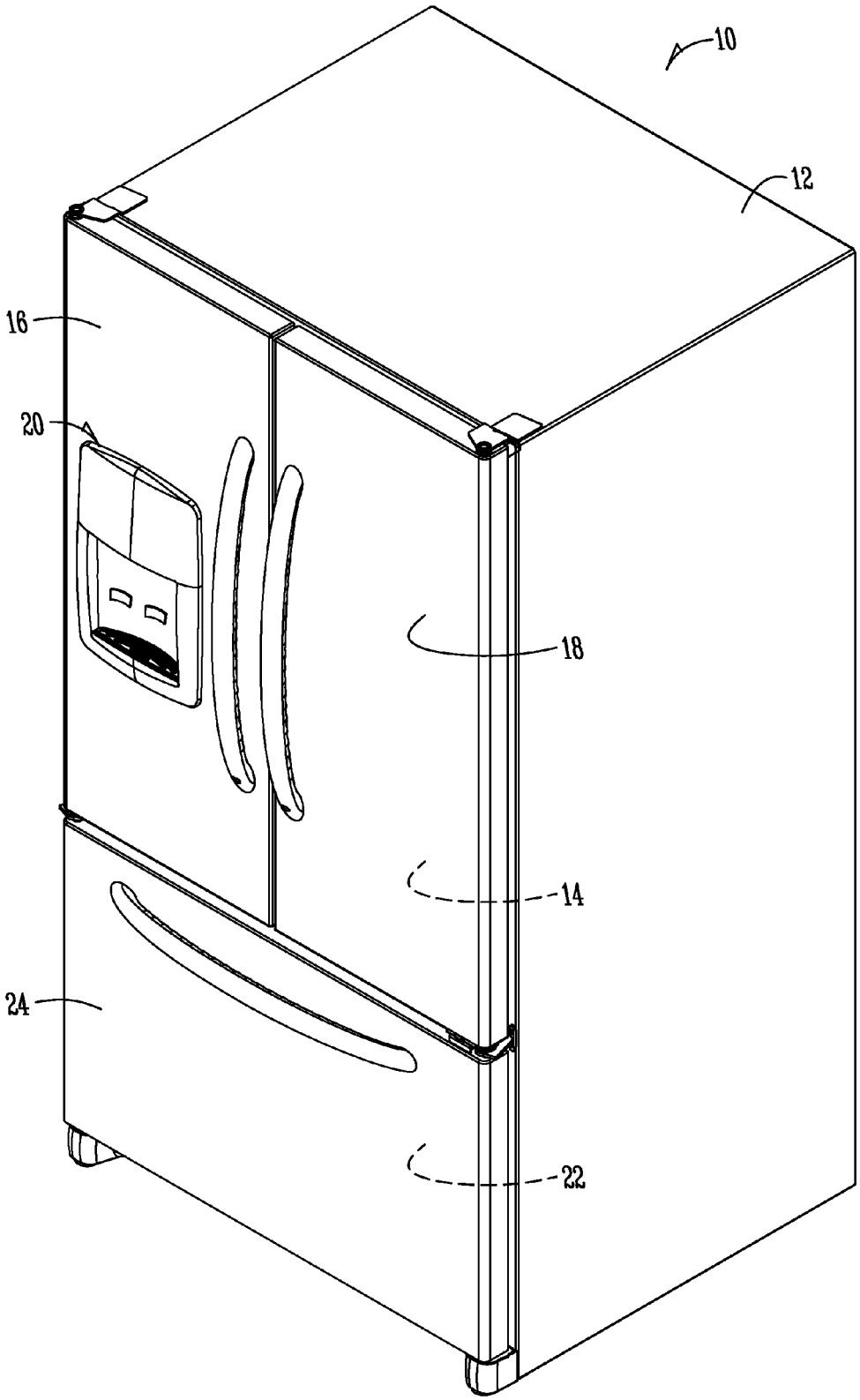
FIG. 1 is a perspective view illustrating exemplary aspects of a refrigerator.
Figure 2:
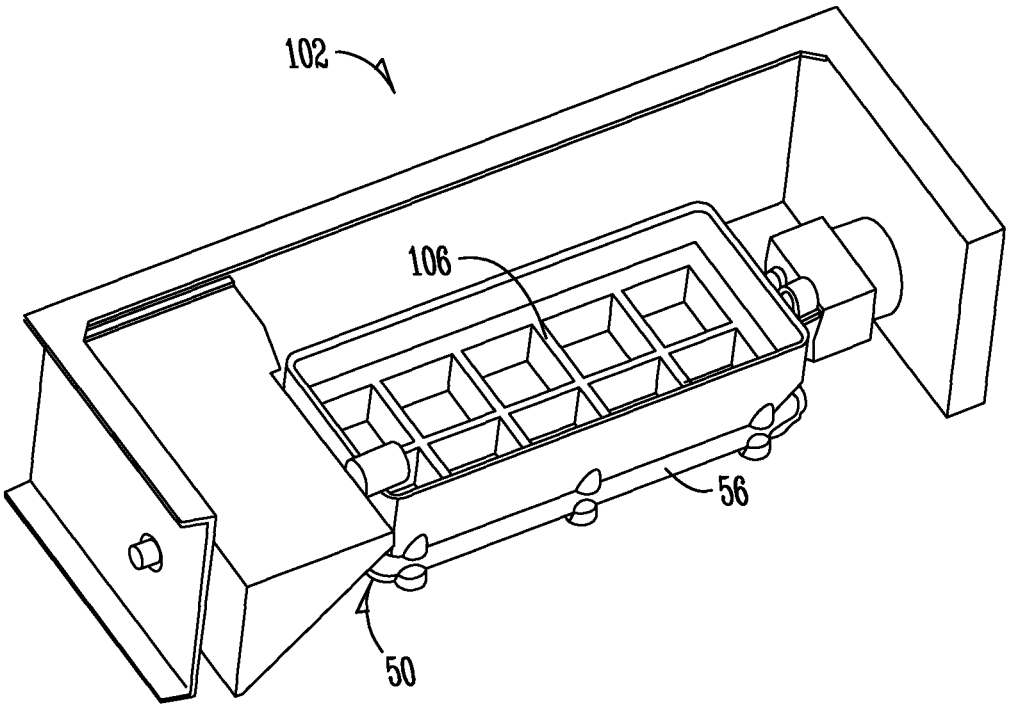
FIG. 2 is a perspective view showing an exemplary embodiment of an icemaker.

Referring to the figures, there is generally disclosed in FIGS. 1-4 a refrigerator 10 configured to dispense ice from an icemaker 102 chilled by a thermoelectric device 50 cooled by fluid or air taken from the fresh food compartment or refrigerator compartment 14 or the freezer compartment 16. The refrigerator 10 includes a cabinet body 12 with a refrigerator compartment or fresh food compartment 14 selectively closeable by a refrigerator compartment door 18 and a freezer compartment 16 selectably closeable by a freezer compartment door 20. A dispenser 22 is included on a refrigerator compartment door 18 for providing dispensions of liquid and/or ice at the refrigerator compartment door 18. Although one particular design of a refrigerator 10 is shown in FIG. 1, other styles and configurations for a refrigerator are contemplated. For example, the refrigerator 10 could be a side-by-side refrigerator, a traditional style refrigerator with the freezer compartment positioned above the refrigerator compartment (top-mount refrigerator), a refrigerator that includes only a refrigerator or fresh food compartment and no freezer compartment, etc. In the figures is shown a bottom-mount refrigerator 10 where the freezer compartment 16 is located below the refrigerator compartment 14.

A refrigerator 10, such as illustrated in FIG. 1 may include a freezer compartment 16 for storing frozen foods, typically at temperatures near or below 0° Fahrenheit, and a fresh food section or refrigerated compartment 14 for storing fresh foods at temperatures generally between 38° Fahrenheit and about 42° Fahrenheit. It is common to include icemakers and ice dispensers in household refrigerators. In a side-by-side refrigerator, where the freezer compartment and the fresh food compartment are located side-by-side and divided by a vertical wall or mullion, the icemaker and ice storage bin are generally provided in the freezer compartment and the ice is dispensed through the freezer door. In recent years it has become popular to provide so-called bottom mount refrigerators wherein the freezer compartment is located below the fresh food compartment, at the bottom of the refrigerator. It is advantageous to provide ice dispensing through the refrigerated compartment door 18 so that the dispenser 22 is at a convenient height. In bottom mount refrigerators the icemaker and ice storage may be provided within a separate insulated compartment 108 located generally within or adjacent to, but insulated from, the fresh food compartment.

To remove heat from the water, it is common to cool the ice mold 106 specifically. Accordingly, the ice mold 106 acts as a conduit for removing heat from the water in the ice mold. As an alternative to bringing freezer air to the icemaker, a heat exchanger 50 comprising a thermoelectric device (TEC) 50 may be used to chill the ice mold 106. The thermoelectric device is a device that uses the Peltier effect to create a heat flux when an electric current is supplied at the junction of two different types of materials. The electrical current creates a component with a warm side and cold side. Thermoelectric devices are commercially available in a variety of shapes, sizes, and capacities. Thermoelectric devices are compact, relatively inexpensive, can be carefully calibrated, and can be reversed in polarity to act as heaters to melt the ice at the mold interface to facilitate ice harvesting. Generally, thermoelectric devices can be categorized by the temperature difference (or delta) between its warm side and cold side. In the ice making context this means that the warm side must be kept at a low enough temperature to permit the cold side to remove enough heat from the ice mold 106 to make ice at a desired rate. Therefore, the heat from the warm side of the thermoelectric device must be removed to maintain the cold side of the mold sufficiently cold to make ice. Removing enough heat to maintain the warm side of the thermoelectric device at a sufficiently cold temperature creates a challenge.

An additional challenge for refrigerators where the icemaker 102 is located remotely from the freezer compartment is the ability to control temperature of the ice mold 106 for facilitating, for example, ice production and harvesting while using the least amount of energy.

Several aspects of the disclosure addressing the aforementioned challenges are illustrated in the views of refrigerator 10 and flow diagram provided in the figures.

In connection with the dispenser 22 in the cabinet body 12 of the refrigerator 10, such as for example on the refrigerator compartment door 18, is an icemaker 102 having an ice mold 106 for extracting heat from liquid within the ice mold to create ice which is dispensed from the ice mold 106 into an ice storage bin 104. The ice is stored in the ice storage bin 104 until dispensed from the dispenser 22. The ice mold 106 or icemaker 102 may include a heat sink 56 for extracting heat from the ice mold 106 using fluid or air as the heat extraction medium. Fluid or air for chilling the ice mold 106 may be transferred from the freezer compartment 16 directly to the icemaker 102 or through the refrigerator compartment 14 to the icemaker 102 on the refrigerator compartment door 18. For example, a heat sink 56 may be positioned in thermal contact with the ice mold 106 to remove heat from the ice mold 106.

A thermoelectric device 50 may also be positioned at the icemaker 102 with its cold side 54 in thermal contact with the ice mold 106 and its warm side in thermal contact with the heat sink 56. For example, in operation, if the heat sink 56 can be kept generally at or near 20° Fahrenheit the warm side 52 of the thermoelectric device 50 may be kept at or near 20° Fahrenheit. The cold side 54 of the thermoelectric device 50 may be then kept at 20° Fahrenheit minus the delta of the thermoelectric device 50. For example, if the thermoelectric device has a delta of 20°, the cold side 54 may be kept at a temperature of 0° Fahrenheit. The ice mold 106 may then be kept at or near the temperature of the cold side 54 of the thermoelectric device 50.

Figure 3:
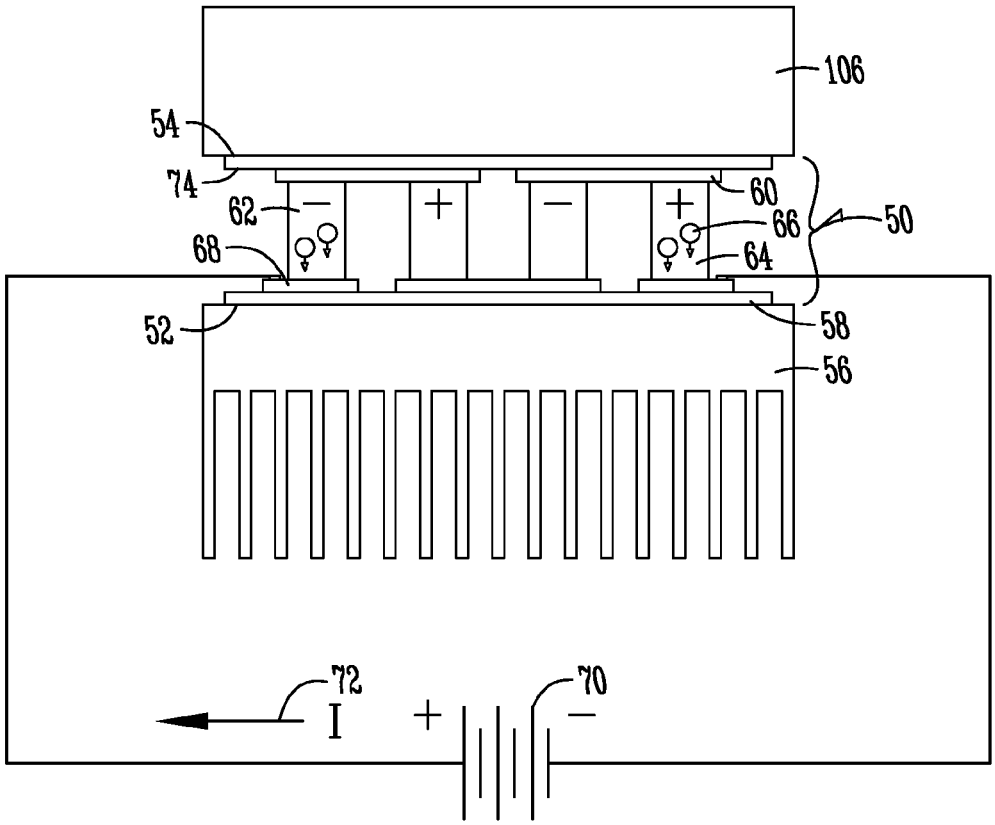
FIG. 3 is a schematic illustration of a thermoelectric device according to one exemplary embodiment.
Figure 4:
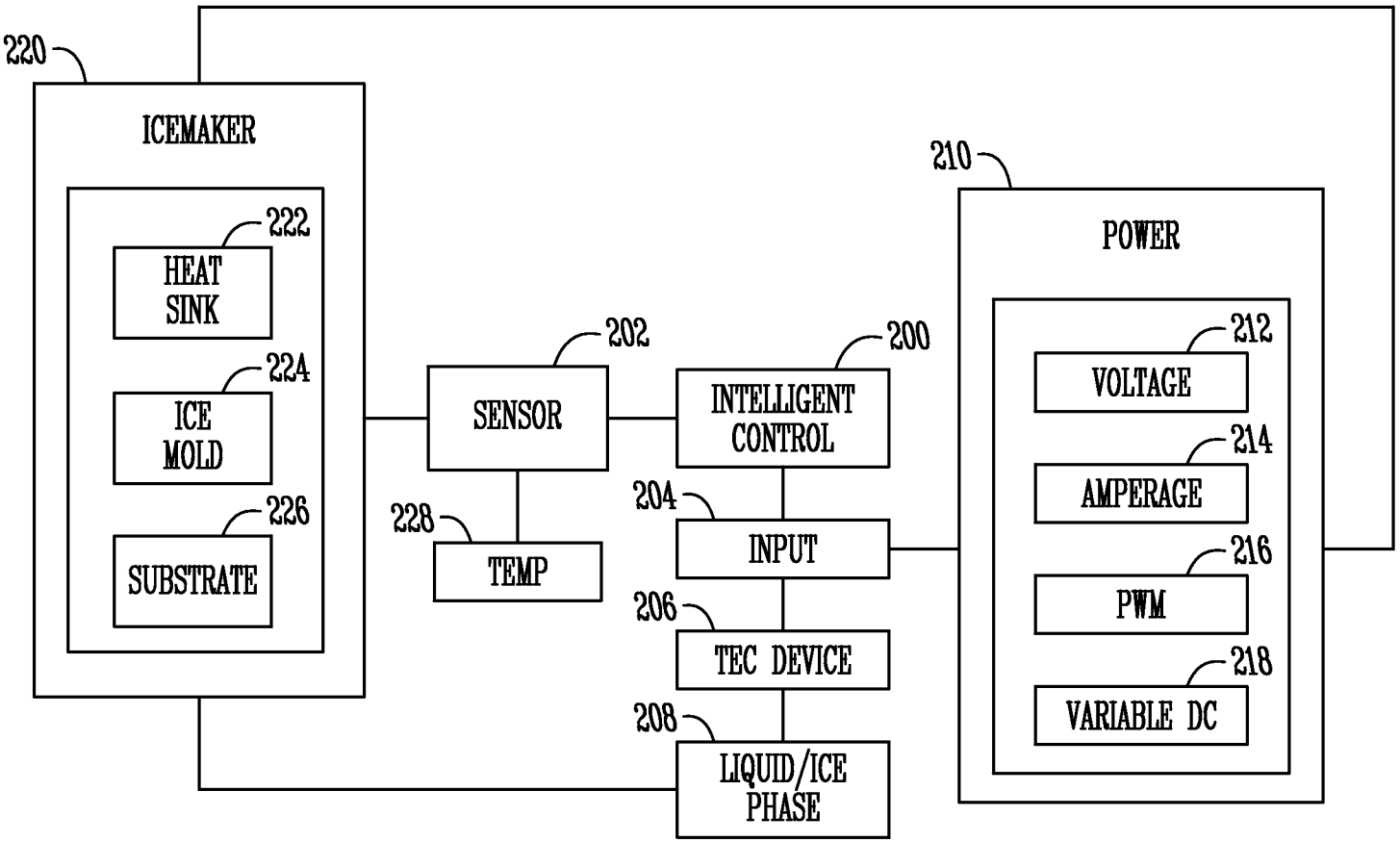
FIG. 4 a flow diagram illustrating a process for intelligently controlling one or more operations of the exemplary configurations and embodiments of the disclosure.

FIG. 3 illustrates an exemplary embodiment of an icemaker configured so that the ice mold 106 may be chilled or heated using a thermoelectric device 50 using, for example, the process shown in FIG. 4. As previously indicated, the thermoelectric device 50 includes a cold side 54 and an opposite warm side 52. The cold side 54 is in thermal contact with ice mold 106. And, the warm side 52 is in thermal contact with the heat sink 56. Using the Peltier effect, a temperature difference is created between the cold side 54 and warm side 52 of the thermoelectric device 50. According to one aspect of the invention, a substrate 74 having a high thermal conductivity may be configured between the ice mold 106 and conductor 60 at the cold side 54 of the thermoelectric device 50. On the opposite side of the thermoelectric device 50, a substrate 58 having a high thermal conductivity may be configured in thermal contact with the heat sink 56 and conductor 68. Configured between conductors 60 and conductors 68 are negative-type pellets 62 and positive-type pellets 64 for providing a flow pathway for charge carriers 66. A power source 70 is connected to conductors 68 for providing a current 72 to the thermoelectric device 50. The voltage and amperage of the power source 70 may be controlled according to one aspect of the disclosure. Using one or more sensors and/or monitoring one or more inputs to the thermoelectric device 50, a system (see FIG. 4) may be configured to monitor a liquid to ice phase change for fluid contained in the ice mold 106. Alternatively, the system may be configured to monitor an ice to liquid phase change, such as for example, in an ice harvesting cycle or a fresh ice production cycle. By reversing the polarity of the thermoelectric device 50, the warm side 52 and cold side 54 are swapped so that the ice mold would be in thermal contact with a warm side of the device 50 and the heat sink 56 would be in thermal contact with the cold side of the device 50. Although the thermoelectric device 50 is described as being in thermal contact with the ice mold 106, the disclosure contemplates that a fluid or air pathway could be configured in thermal contact with the ice mold 106 and the thermoelectric device 50 to chill or warm the ice mold 106 from a remotely positioned thermoelectric device 50.

Temperature control for the thermoelectric device 50 may be configured to use a thermostatic temperature control or a steady-state temperature control. With a thermostatic control, a thermal load is maintained between two temperature limits. For example, in an ice making cycle, the intelligent control (as shown in FIG. 4) 200 may be figured to energize the power source 210 when a thermal load rises to or above 32° Fahrenheit then turning off the power source 210 when the temperature cools to 29° Fahrenheit. The system would then therefore be continually varying the temperature between 29° and 32° Fahrenheit. To monitor operating temperatures of the thermoelectric device 50 during a liquid to ice phase change or a ice to liquid phase change 208, one or more sensors 202 may be configured at locations to sense the temperature 228 of, for example, the ice mold 224, the heat sink 222 or a substrate 226 (e.g., a conductor). The substrates 226 in thermal contact with the ice mold 224 or the heat sink 222 may also be configured with sensors 202 to monitor the temperature 228 to determine the liquid to ice phase change or the ice to liquid phase change 208. Alternatively, conductors 60 or 68 may be configured with one or more sensors 202 for monitoring the temperature 228 of a liquid to ice phase or ice to liquid phase change 208. The intelligent control 200 can be configured to control the flowrate of air or liquid to the heat sink 222 depending upon the temperature 228 sensed by one or more sensors 202 at the heat sink 222. Thus, according to one aspect of the disclosure, one or more sensors 202 may be configured at the icemaker 220 to monitor the temperature 228 of a heat sink 222 in thermal contact with the ice mold 224 or a substrate 226 in thermal contact with the ice mold 224 or the heat sink 222. Using the intelligent control 200 to monitor the temperature 228 using one or more sensors 202 at the above described locations provides one way of monitoring the liquid to ice or ice to liquid phase change 208 being driven by the thermoelectric device 206. The rate of flow of liquid or air to the heat sink 222 may be controlled by the intelligent control 200 to control the temperature 228 of the warm side of the thermoelectric device 206. If, for example, the intelligent control 200 determines from a reading from the sensor 202 that the phase of the liquid or ice 208 is not at a temperature 228 to change, whether to ice or whether to liquid depending on whether an ice production, ice harvesting or fresh ice production cycle is being performed, the intelligent control 200 may provide a correction to increase or decrease the temperature 228 by increasing/decreasing the flowrate of air or liquid to the heat sink 56.

In addition to controlling the rate of flow across the heat sink 222 of the icemaker 220, the inputs 204 for operating the thermoelectric device 206 may be controlled using intelligent control 200 to control the liquid to ice or ice to liquid phase change 208 in the ice mold 224 of the icemaker 220. For example, the thermoelectric device 206 may be operated in a steady-state control by varying the inputs to the thermoelectric device 206 using an intelligent control 200. In one aspect, the intelligent control 200 varies the power inputs 210 to the thermoelectric device 206 to maintain the ice mold 224 of the icemaker 220 at a desired temperature 228. In operation, for example, the intelligent control monitors the temperature 228 via one or more sensors 202 at the ice mold 224 of the icemaker 220 (assuming that the temperature 228 of the ice mold 224 is generally indicative of the liquid to ice or ice to liquid phase 208 of the liquid in the ice mold 224 of the icemaker 220). The intelligent control 200 may also be configured to alter the temperature 228 of the thermoelectric device 206 by changing one or more of the inputs 204, such as the power 210. In one aspect of the invention, the voltage 212 of the power source 210 may be controlled by the intelligent control 200 to maintain the temperature 228 across the thermoelectric device 206 at a desired temperature 228 for the liquid to ice phase or ice to liquid phase change 208 to occur in the ice mold 224. Similarly, the amperage 214 of the power source 210 supplied as an input 204 to the thermoelectric device 206 may be controlled using the intelligent control 200 for controlling the temperature 228 of the liquid to ice or ice to liquid phase change 208 in the ice mold 224. The power 210 supplied as an input 204 to the thermoelectric device 206 may also be varied using pulse-width modulation (PSM) 216 or a variable direct current 218 such as linear control. Using pulse width modulation 216 to control power 210 as an input 204 to the thermoelectric device 206, the frequency for pulsing the thermoelectric device 206 on and off may be controlled, for example, under operation of the intelligent control 200. For example, the intelligent control 200 may be configured to control the percentage of "on" time versus "off" time (i.e., the duty cycle) during pulse width modulation 216 of the power 210 provided to the thermoelectric device 206. Alternatively, a variable DC 218 level may be used to power the thermoelectric device 206. Using for example, a linear drive current as power 210 input 204 into the thermoelectric device 206 under control of the intelligent control 200, the thermoelectric device 206 may be linearly driven to control the liquid to ice or ice to liquid phase change 208 in the ice mold 224 of the icemaker 220. One or more sensors 202 positioned in locations at the icemaker 220, as previously described, may be used to monitor the temperature 228 and provide feedback to the intelligent control 200 to provide correction to the inputs 204 from the power sources 210 (e.g., voltage 212, amperage 214, pulse width modulation 216, variable DC 218). For example, since the liquid to ice phase change or the ice to liquid phase change 208 requires a certain amount of energy for the change to occur, this energy may be detected by one or more sensors 202 positioned at one or more locations at the icemaker 220 (e.g., heat sink 222, ice mold 224, substrate 226, conductor 60, etc.) to determine the temperature 228 and provide information to the intelligent control 200 based on inputs 204 to the thermoelectric device 206. For example, the power 210 inputs 204 such as voltage 212, amperage 214, pulse width modulation 216 or variable DC 218 may be controlled or corrected depending upon the phase of the liquid to ice stage or ice to liquid stage 208. In one aspect of the disclosure, in a liquid to ice phase change 208, the temperature 228 of the liquid in the ice mold 224 may remain generally flat although the inputs 204 to the thermoelectric device 206 may increase at least until the entire ice mold 224 is frozen (i.e., all the water in the mold is frozen) and ice is formed. Alternatively, when ice in contact with a surface of the ice mold 224 is being changed from ice to liquid, the temperature 228 of the ice mold 224 may be fairly level despite the increase in inputs 204 (e.g., power 210 to the thermoelectric device 206) until the phase change occurs. In this manner, power 210 provided as an input 204 to the thermoelectric device 206 may be monitored (e.g. voltage 212, amperage 214, pulse width modulation 216 or variable DC 218 may be monitored) to determine the phase of the liquid to ice or ice to liquid phase change 208 in the ice mold 224 of the icemaker 220. Temperature 228 taken by one or more sensors 202 positioned at, for example, a heat sink 222 in thermal contact with the ice mold 224 or a substrate 226 may be used to provide a feedback response to the intelligent control 200 for correcting or adjusting the inputs 204 to the thermoelectric device 206. Thus, using at least in part, existing features and inputs to a thermoelectric device 50, a low energy system for monitoring the ice to liquid or liquid to ice phase change 208 for an icemaker 220 chilled or warmed by a thermoelectric device 206 is provided.

The foregoing description has been presented for the purposes of illustration and description. It is not intended to be an exhaustive list or limit the invention to the precise forms disclosed. It is contemplated that other alternative processes and methods obvious to those skilled in the art are considered included in the invention. The description is merely examples of embodiments. For example, the inputs to the thermoelectric device (e.g., fluid flow or air flow rates across heat sink 56, power 210 inputs 204 controlled by intelligent control 200) may be varied according to type of cycle (ice production, fresh ice production, ice harvesting) being conducted and the desired performances for the refrigerator. It is understood that any other modifications, substitutions, and/or additions may be made, which are within the intended spirit and scope of the disclosure. From the foregoing, it can be seen that the exemplary aspects of the disclosure accomplishes at least all of the intended objectives.

What is claimed is:

1. A refrigerator that has a fresh food compartment, a freezer compartment, and a door that provides access to the fresh food compartment, the refrigerator comprising:

an icemaker mounted remotely from the freezer compartment, the icemaker including an ice mold with an icemaking cycle having a liquid to ice phase change;

a thermoelectric device, the thermoelectric device having a cold side and a warm side;

a controller in operable communication with an input to the thermoelectric device;

a sensor in operable communication with the input to the thermoelectric device and the controller;

a temperature feedback response from the input to the thermoelectric device for monitoring the liquid to ice phase change of the icemaking cycle;

a heat sink in thermal contact with the warm side of the thermoelectric device, the sensor in thermal communication with the heat sink for providing a temperature reading to the controller;

a substrate in thermal contact with the cold side of the thermoelectric device, the sensor in thermal communication with the substrate for providing a temperature reading to the controller for determining the liquid to ice phase change of the icemaking cycle; and a substrate having a high thermal conductivity in thermal contact with the warm side of the thermoelectric device.

2. The refrigerator of claim 1 wherein the input comprises a voltage provided to the thermoelectric device, wherein the feedback response from the voltage input determines the liquid to ice phase change of the icemaking cycle.

3. The refrigerator of claim 1 wherein the input comprises an amperage provided to the thermoelectric device, wherein the feedback response from the amperage input determines the liquid to ice phase change of the icemaking cycle.

4. The refrigerator of claim 1 wherein the input comprises a frequency of a pulse-width modulation (PWM) provided by the controller, wherein the feedback response from the frequency of the PWM determines the liquid to ice phase change of the icemaking cycle.

5. The refrigerator of claim 1 wherein the input comprises a linear drive current for providing a variable (DC) level, wherein the feedback response from the linear drive current providing the variable DC level input determines the liquid to ice phase change of the icemaking cycle.

6. The refrigerator of claim 1 wherein the controller correlates the temperature reading from the heat sink with the input to provide the feedback response to make a correction to the input based on the liquid to ice phase change of the icemaking cycle.

7. An icemaker comprising:

an ice mold with an icemaking cycle having a liquid to ice phase change;

a thermoelectric device, the thermoelectric device having a cold side and a warm side;

an input to the thermoelectric device;

a controller in operable communication with the thermoelectric device and the input;

a sensor in operable communication with the thermoelectric device;

a temperature feedback response from the thermoelectric device to the controller for monitoring the liquid to ice phase change of the icemaking cycle;

a substrate in thermal contact with the cold side of the thermoelectric device, the sensor in thermal communication with the substrate for providing a temperature reading to the controller for determining the liquid to ice phase change of the icemaking cycle; and a substrate in thermal contact with the warm side of the thermoelectric device.

8. The icemaker of claim 7 wherein the input comprises a voltage provided to the thermoelectric device, wherein the feedback response from the voltage input determines the liquid to ice phase change of the icemaking cycle.

9. The icemaker of claim 7 wherein the input comprises a amperage provided to the thermoelectric device, wherein the feedback response from the amperage input determines the liquid to ice phase change of the icemaking cycle.

10. The icemaker of claim 7 in combination with a refrigerator that has a fresh food compartment, a freezer compartment, and a door that provides access to the fresh food compartment.

11. The icemaker of claim 10 wherein the icemaker further comprises an ice to liquid phase change monitored to determine an ice harvesting cycle or a fresh ice production cycle.

12. The icemaker of claim 7 wherein the controller correlates a temperature reading from the ice mold with the input to provide the feedback response to make a correction to the input based on the liquid to ice phase change of the icemaking cycle.

13. A method for cooling in a refrigerator that has a fresh food compartment, a freezer compartment, and a door that provides access to the fresh food compartment, the method comprising:

providing an icemaker mounted remotely from the freezer compartment, the icemaker including an ice mold with an icemaking cycle having a liquid to ice phase change;

locating a thermoelectric device, the thermoelectric device having a cold side and a warm side, whereby a substrate is in thermal contact with the warm side of the thermoelectric device and a substrate is in thermal contact with the cold side of the thermoelectric device;

controlling an input to the thermoelectric device using a controller in operable communication with the input and the thermoelectric device;

sensing a signal from a sensor in operable communication with the input to the thermoelectric device and the controller;

monitoring a temperature feedback response from the input to the thermoelectric device for determining the liquid to ice phase change of the icemaking cycle, or reversing polarity of the thermoelectric device and monitoring a temperature feedback response from the input to the thermoelectric device for determining the ice to liquid phase change of the icemaking cycle;

reading a temperature from the substrates to determine the liquid to ice phase or ice or ice to liquid phase change;

reading a temperature from the ice mold in thermal contact with the cold side of the thermoelectric device for determining the liquid to ice phase change of the icemaking cycle, or reading a temperature from the ice mold in thermal contact with the warm side of the thermoelectric device for determining the ice to liquid phase of the icemaking cycle.

14. The method of claim 13 further comprising controlling a voltage input to the thermoelectric device and monitoring the feedback response from the voltage input to determine the liquid to ice phase change of the icemaking cycle.

15. The method of claim 13 further comprising controlling an amperage input to the thermoelectric device and monitoring the feedback response from the amperage input to determine the liquid to ice phase change of the icemaking cycle.

16. The method of claim 13 further comprising reading a temperature from a heat sink in thermal contact with the warm side of the thermoelectric device for determining the liquid to ice phase change of the icemaking cycle.

17. The method of claim 13 further comprising correlating the temperature reading from the ice mold with the input to provide the feedback response to make a correction to the input based on the liquid to ice phase change of the icemaking cycle.

* * * * *